US005928014A

United States Patent [19]

Sawayanagi et al.

[11] Patent Number: 5,928,014

[45] Date of Patent: Jul. 27, 1999

[54] ELECTRICAL CONNECTOR HAVING A PAIR OF CONNECTOR HOUSINGS

[75] Inventors: Masahiro Sawayanagi; Nobuyuki Akeda, both of Shizuoka, Japan

[73] Assignee: Yazaki Corporation, Tokyo, Japan

[21] Appl. No.: 09/046,579

[22] Filed: Mar. 24, 1998

[30] Foreign Application Priority Data

Mar. 26, 1997 [JP] Japan ..... 9-073557

[51] Int. Cl.[6] ..... H01R 13/62

[52] U.S. Cl. ..... 439/157; 439/347

[58] Field of Search ..... 439/157, 347, 439/310

[56] References Cited

U.S. PATENT DOCUMENTS

| | | | |
|---|---|---|---|
| 4,875,873 | 10/1989 | Ishizuka et al. | 439/157 |
| 5,376,009 | 12/1994 | Olson et al. | 439/157 |
| 5,593,309 | 1/1997 | Post et al. | 439/347 |
| 5,618,194 | 4/1997 | Maue et al. | 439/157 |

FOREIGN PATENT DOCUMENTS 6-215827 8/1994 Japan .

*Primary Examiner*—Neil Abrams
*Assistant Examiner*—J. F. Duverne
*Attorney, Agent, or Firm*—Armstrong, Westerman, Hattori, McLeland & Naughton

[57] ABSTRACT

An electrical connector includes a pair of opposing connector housings (A) (B) mateable to one another, in which terminals accommodated therein are electrically coupled. Furthermore, the connector has a sliding member, (C) and a sliding member insertion slit (6) (12) is provided in each of the connector housings (A) (B) so as to extend as crossing with the mating direction of the connector housings (A) (B). From an inner surface of the sliding member insertion slit (12) of one of the connector housings (A) (B) is protruding a cam pin (13). Meanwhile, the sliding member (C) has a cam groove (15) which engages with the cam pin (13) so as to guide the pair of connector housings (A) (B) up to the full mated state. The sliding member (C) has a provisional lock (19) for provisionally locking the sliding member, (C) which protrudes from a sliding face of the sliding member (C) and is resiliently supported on the sliding member (C). An increased insertion force allows the sliding member (C) to ride over the provisional lock (19) so as to fully insert the sliding member (C).

7 Claims, 6 Drawing Sheets

ELECTRICAL CONNECTOR HAVING A PAIR OF CONNECTOR HOUSINGS

FIELD OF THE INVENTION

The present invention relates to an electrical connector having a pair of connector housings that can surely mate with one another in fully engaged condition.

BACK GROUND OF THE INVENTION

Regarding an electrical connector having mating connector housings, a male connector housing securely accommodates terminals in its receiving cavities. Meanwhile, a female connector housing having an engagement guiding hood accommodates securely terminals corresponding to the male connector terminals in its receiving cavities. The full mating of the male and female connector housings allows the forward ends of the terminals to be coupled to their associated terminals for electrical connection.

Where such connector housings have a lot of terminals, the engagement of the pair of connector housings requires a large insertion force, causing a laborious work for the engagement of the connector housings.

To reduce this laborious work, sliding-member-equipped, lever-equipped connectors, or the like have been employed.

One of such sliding-member-equipped connectors has been disclosed in Japanese Patent Application laid-open No. H. 6-215827.

The sliding-member-equipped connector has a sliding member insertion slit extending substantially perpendicular to the connector engagement direction. The sliding member has a cam groove inclined to the engagement direction. The cam groove is engageable with a cam pin provided in the male connector housing.

In an initial stage of the engagement of the connector housings, the sliding member enters the male connector housing so that the cam pin advances into the cam groove. A further insertion of the sliding member causes the cam groove to push the cam pin. Thereby, the male connector housing moves in the connector housing engagement direction. The full insertion of the sliding member allows the male and female connector housings to be completely engaged with one another.

The insertion of the sliding member provides a larger engagement force for the mating housings due to an inclined sliding surface of the cam groove, resulted in an advantageous decrease in the amount of the connector housing mating work.

SUMMARY OF THE INVENTION

In wiring work of electrical wires related to the above, incomplete insertion of the sliding member may undesirably happen occasionally in engagement of a number of connector housings. Hence, such incomplete insertion of the sliding member causes an incomplete engagement of the pair of mating connector housings so that terminals therein are not in electrically connected relation nor in a stable connected relation. In view of the subject of the known connector, an object of the present invention is to provide a connector that eliminates such incomplete insertion of the sliding member.

For achieving the object, an electrical connector according to the present invention includes:

a pair of first and second connector housings mateable with one another, in which terminals are accommodated therein for electrical connection, a sliding member, a sliding member insertion slit respectively provided in the connector housings and extending in a direction crossing with the mating direction of the connector housings, a cam pin protruding from an inner surface of the sliding member insertion slit of the second connector housing, a cam groove formed in the sliding member, which engages with the cam pin so as to guide the pair of connector housings up to the fully mated state, and a provisional lock for provisionally locking the sliding member to the first connector housing, which protrudes from a sliding face of the sliding member and is resiliently supported on the sliding member. In addition, an increased insertion force allows the sliding member to be released from the provisional lock so as to fully insert the sliding member into the connector housings.

The provisional lock may be formed so as to protrude from a resilient support piece provided in the sliding member and abuts against an outer surface of the first connector housing in the provisional lock condition of the sliding member.

Preferably, the sliding member has a stopper that abuts against the first connector housing when the sliding member has been fully inserted into the first connector housing.

Furthermore, the sliding member has a resiliently deflectable, disconnection preventing portion that locks to an inner face of the first connector housing when the sliding member has been fully inserted in the connector housings.

DESCRIPTION OF PREFERRED EMBODIMENT

Figure 1:
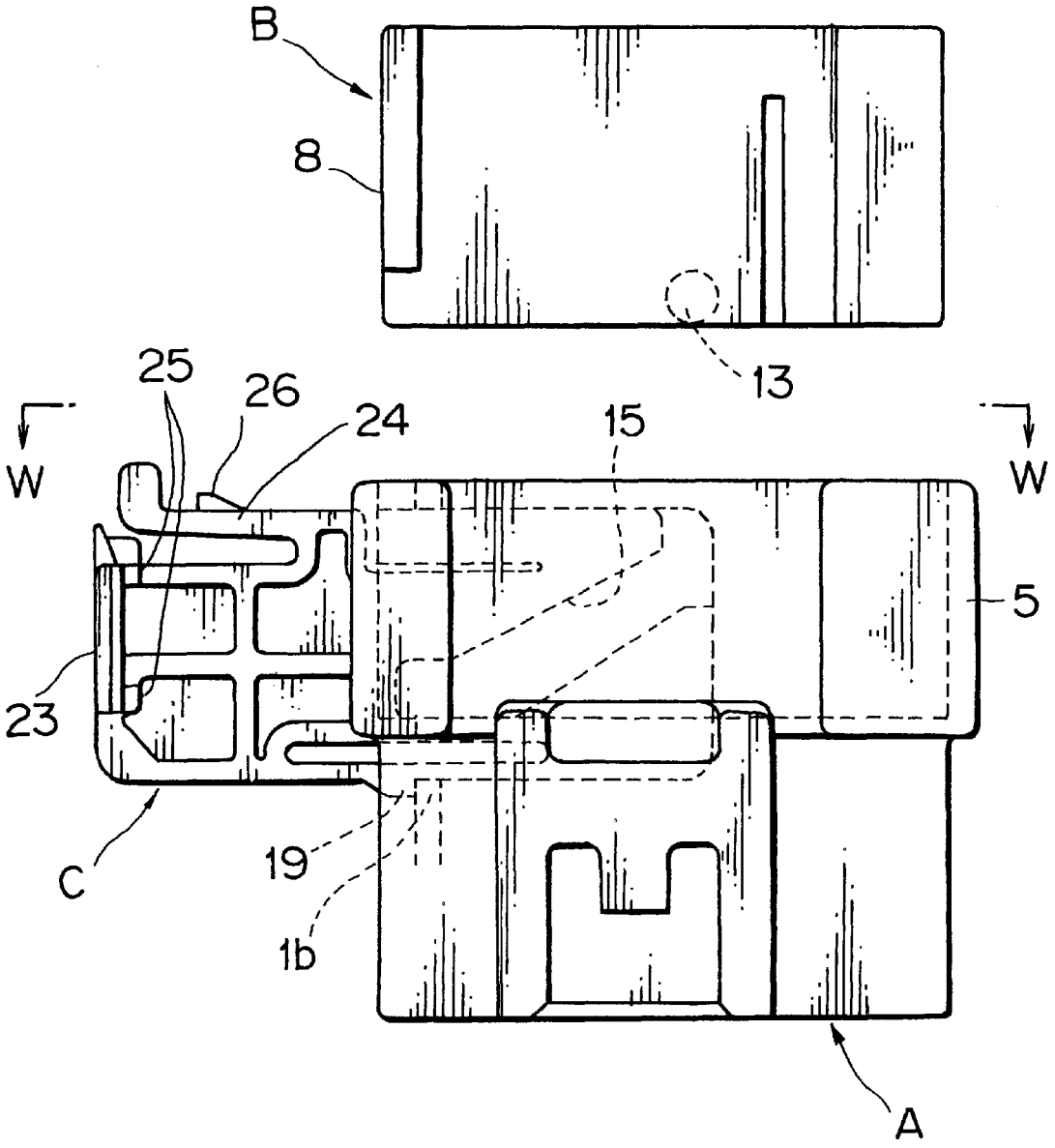
FIG. 1 shows a plan view of a connector according to the invention, which is in a state before the engagement of a pair of connector housings.
Figure 2:
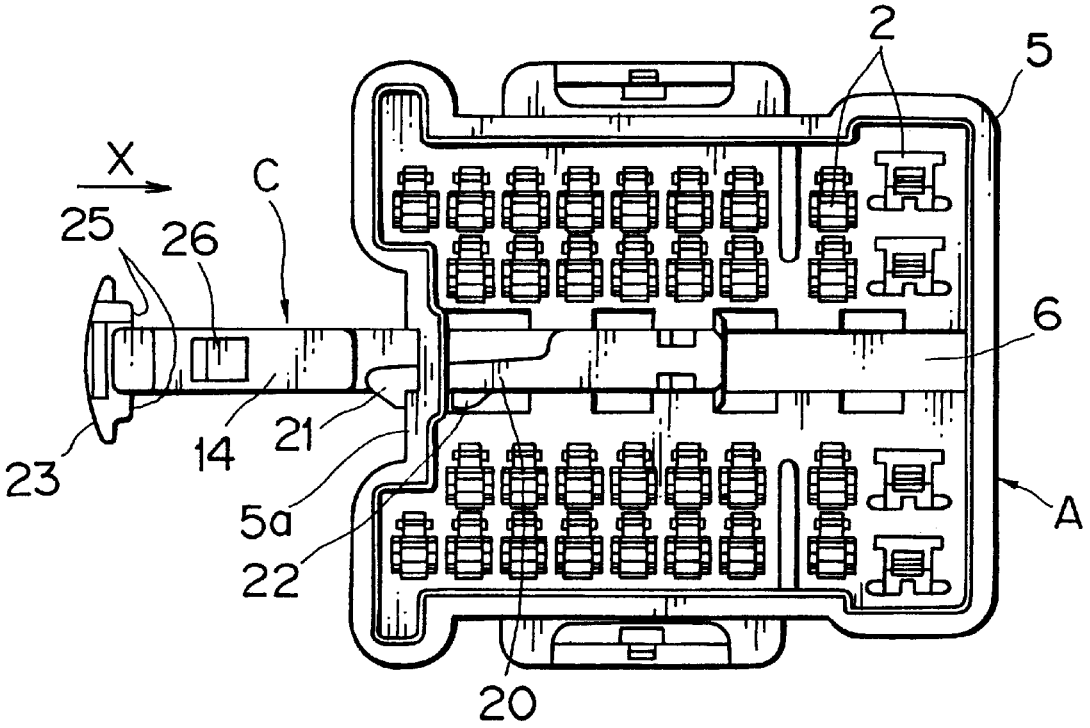
FIG. 2 is a view taken on a line W—W of FIG. 1.
Figure 3:
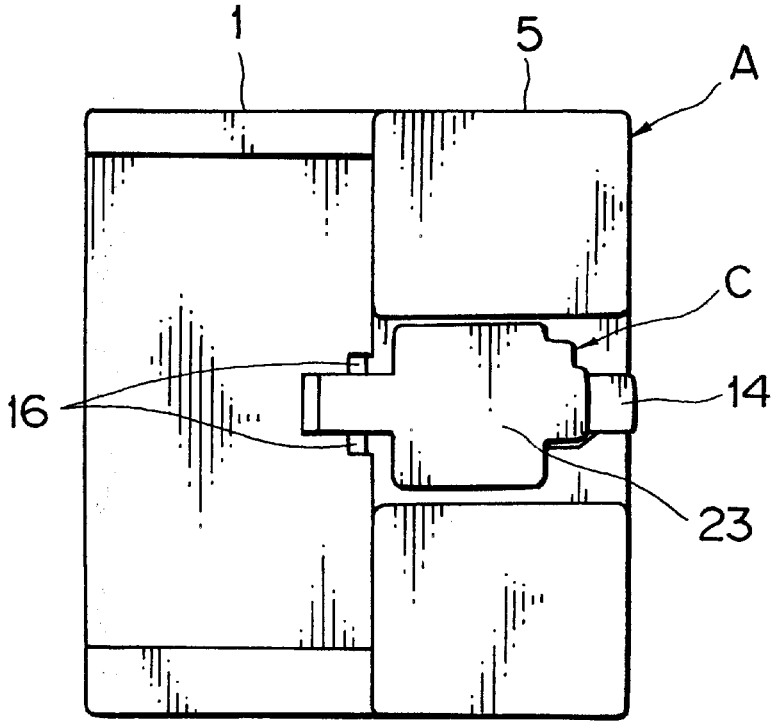
FIG. 3 is a view taken in the direction of an arrow X in FIG. 2.

Referring to the accompanied drawings of FIGS. 1 to 12, the invention will be discussed hereinafter.

A female connector housing A has a main body 1 in which includes a plurality of terminal receiving cavities 2. Each terminal receiving cavity 2 has a flexible lock arm 3 therein formed with a lock protrusion 4 for securing terminals thereto.

The main body 1 has an engagement surface l*a* from which a hood 5 extends for guiding a male connector housing B in the engagement direction.

The female connector housing A has a sliding member insertion slit 6 extending into the main body 1.

Figure 4:
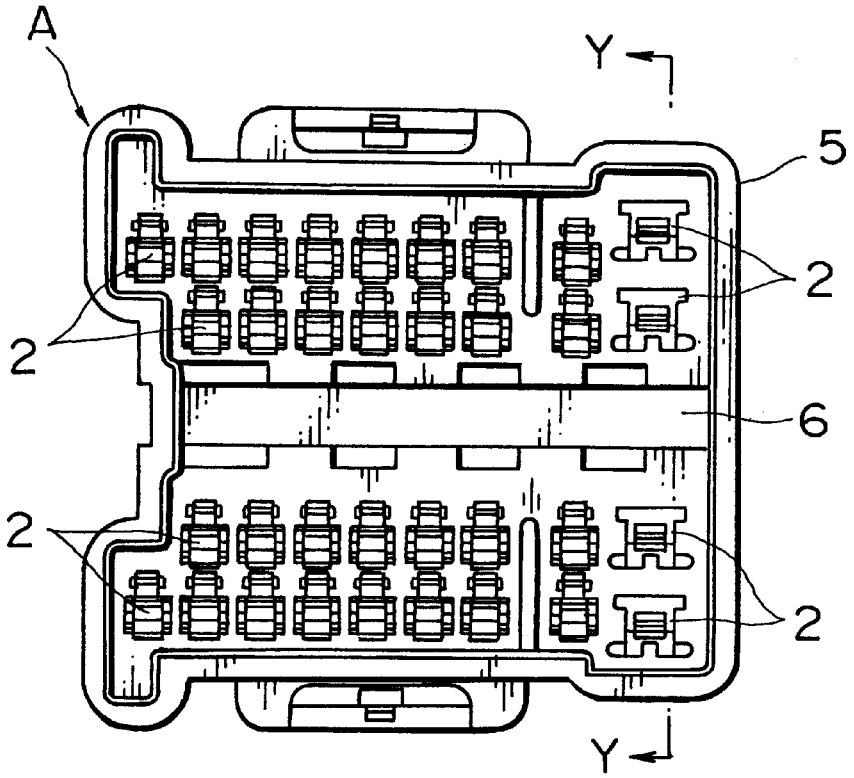
FIG. 4 is the front view of a female connector housing taken in the housing engagement direction.
Figure 5:
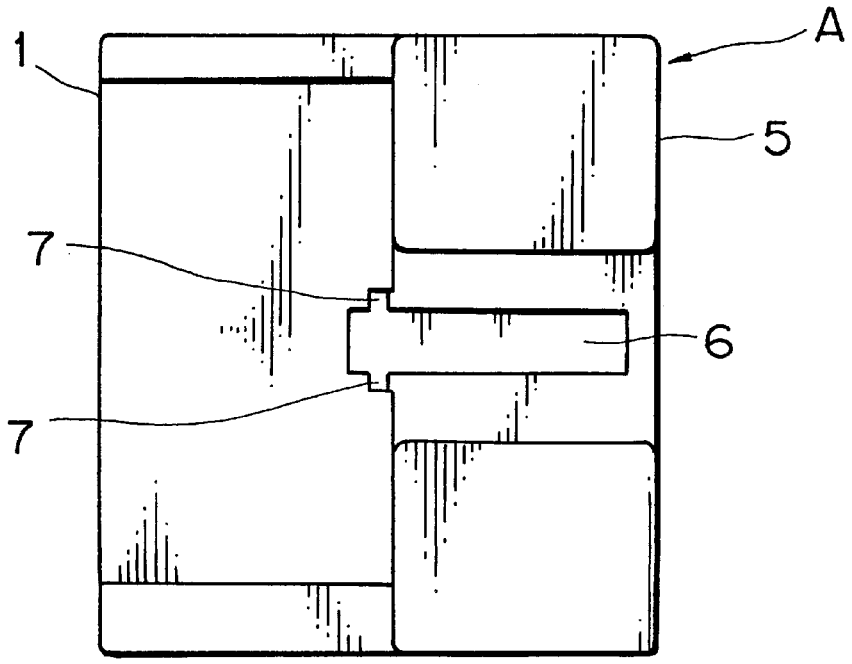
FIG. 5 is a side view of FIG. 4.
Figure 6:
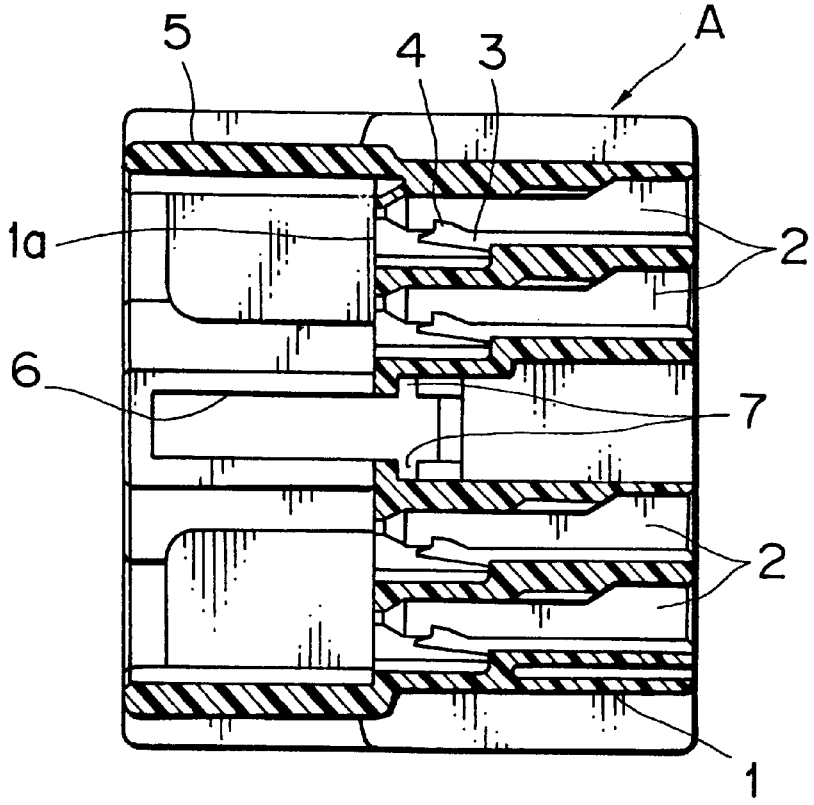
FIG. 6 is a sectional view taken on a line Y—Y of FIG. 4.
Figure 7:
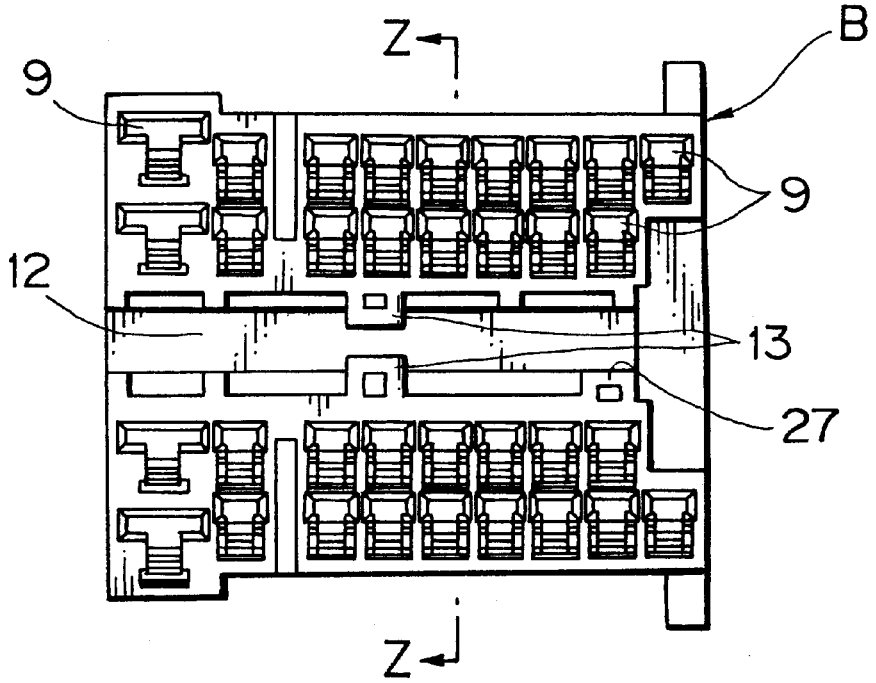
FIG. 7 is the front view of a male connector housing taken in the housing engagement direction.
Figure 8:
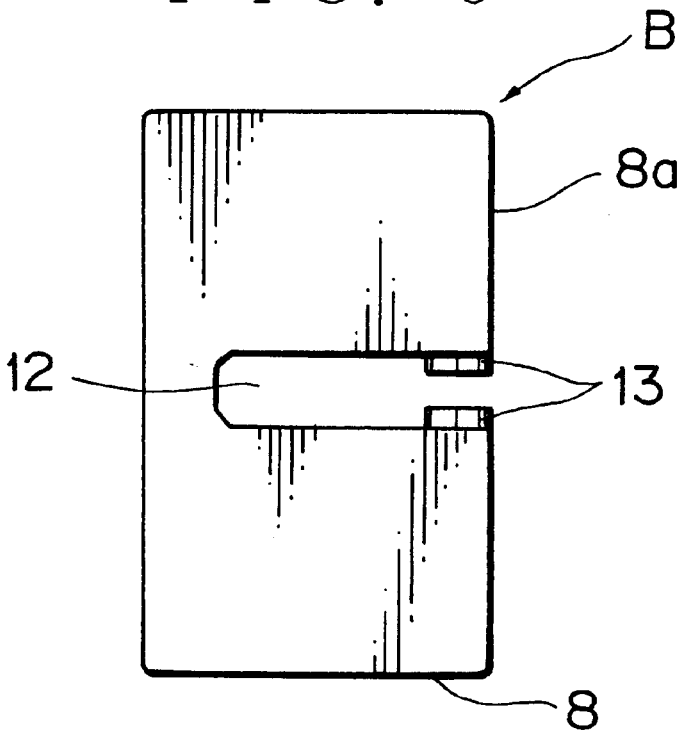
FIG. 8 is a side view of FIG. 7.
Figure 9:
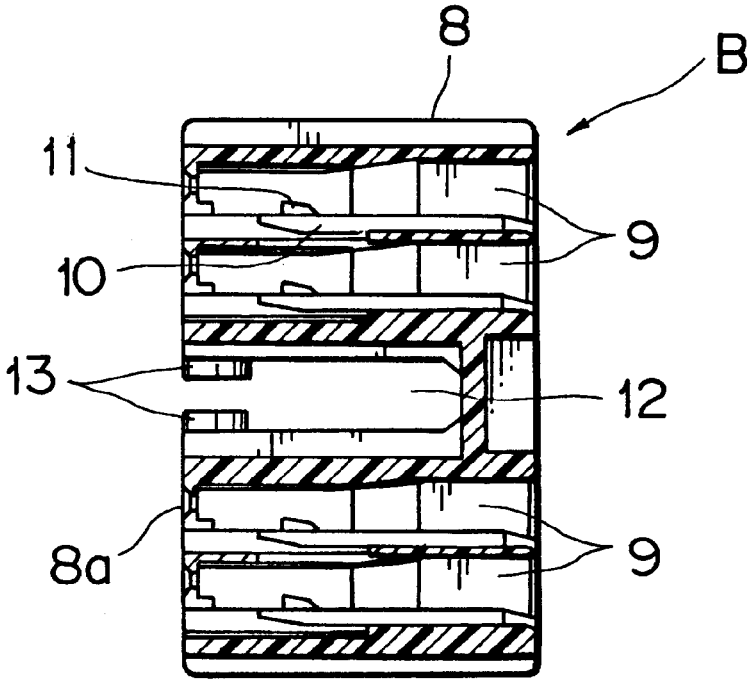
FIG. 9 is a sectional view taken on a line Z—Z of FIG. 7.

The sliding member insertion slit 6 is substantially rectangular and is formed with a guide groove 7 at an inner surface thereof (see FIGS. 4 to 6).

The male connector housing B has a main body 8, an outer surface of which is engageable with an inner surface of hood 5. The main body 8 is formed with terminal receiving cavities 9 associated with the cavities 2. The terminal receiving cavity 9 is provided with a flexible lock arm 10 therein that is formed with a lock protrusion 11 for securing the terminal.

In an engagement surface 8*a* of the main body 8, there is provided with a sliding member insertion slit 12. The sliding member insertion slit 12 is formed with a protruding cam pin 13 at an inner surface thereof, cam pin 13 being positioned adjacent to the engagement surface 8*a* (see FIGS. 7 to 9).

Thus, the sliding member C is inserted into the sliding member insertion slits 6, 12 of the connector housings A, B. The sliding member C has a main body 14 with a substantially rectangular leading end in the insertion direction shown by the arrow F. The main body 14 has a cam groove 15 inclined to the insertion direction of the sliding member C.

Furthermore, the main body 14 has a pair of protrusions each projecting each side thereof which are slidable along associated guide grooves 7 formed in the connector housings A. The main body 14 has an elongated opening 17 near the lower end thereof, which provides a resilient support piece 18 for a provisional lock 19 outwardly projecting from the support piece 18 (see FIGS. 10 and 12).

The provisional lock 19 has a vertical face 19*a* at the leading end thereof in the insertion direction F, and has an inclined face 19*b* in the opposite side of the vertical face 19*a*.

On an upper portion of the main body 14, there is provided with a resilient support piece 20 in a flexible arm shape. On a side surface of the support piece 20 is provided a provisional locking stopper 21 for provisionally stopping the sliding member C and a provisional locking protrusion 22 for locking the sliding member C at the provisional locking position.

The provisional locking stopper 21 has a vertical face 21*a* in the forward side thereof relatively to the insertion direction F and also has an inclined face 21*b* in the backward side thereof.

Figure 10:
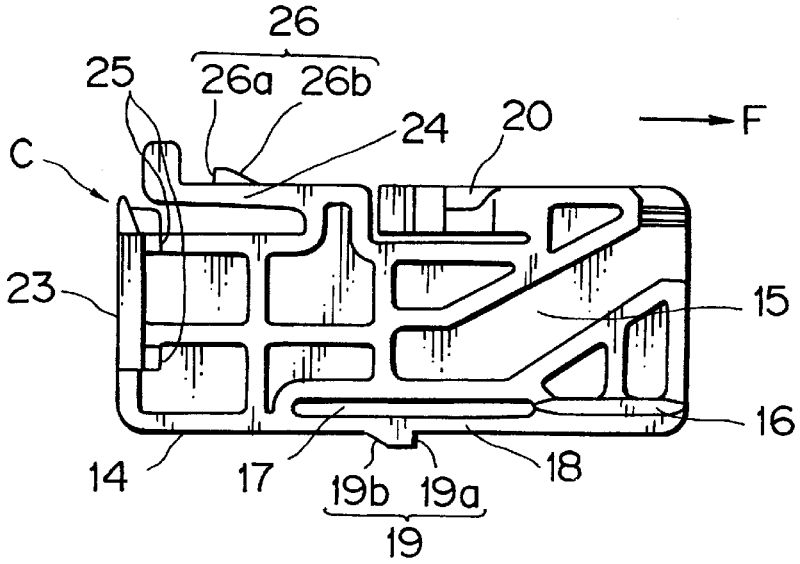
FIG. 10 is a side view of a sliding member.
Figure 11:
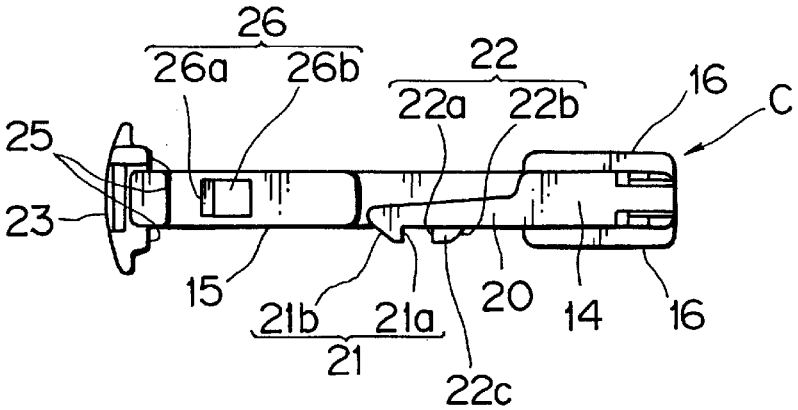
FIG. 11 is a plan view of the sliding member.

The provisional locking protrusion 22 is located forward from the provisional locking the stopper 21, and has a vertical face 22*a* opposed to the vertical face 21*a* with a space therebetween and an inclined face 21*b* formed in the opposite side of the vertical face 22*a* (see FIGS. 10 and 11).

The main body 14 has an actuating portion 23 at the rear end thereof for moving the sliding member C, and has a stopper 25 in a rear surface of the actuating portion 23.

On an upper portion of the main body 14 is provided with a backwardly extending flexible arm 24 that has a disconnection preventing portion 26 on an upper face thereof.

Figure 12:
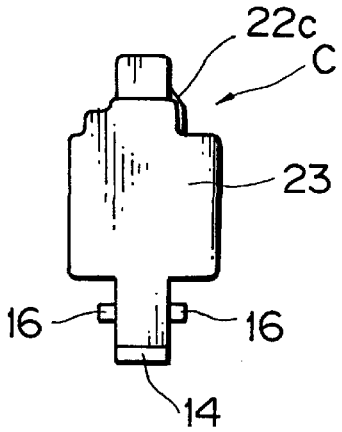
FIG. 12 is a rear view of the sliding member.

The disconnection preventing portion 26 includes a vertical face 26*a* in the rear side relatively to the insertion direction F and an inclined face 26*b* in the opposite side of the vertical face 26*a* (see FIGS. 10 to 12).

Next, referring the drawings, engagement steps of thus configured, sliding-member-equipped connector will be discussed.

The terminal receiving cavities 2 in the female connector housing A securely receives terminals. The leading end of the sliding member C is inserted into the sliding member insertion slit 6 of the connector housing A. Then, pushing the actuating portion 23 advances the sliding member C, while the protrusion 16 slides along the guide groove 7 of the connector housing A.

At a halfway insertion point of the sliding member C, the vertical face 19*a* of the provisional lock 19 abuts against an outer wall 1*b* of the main body 1 (see FIG. 1). At the same time, the vertical face 21*a* of the provisional locking stopper 21 abuts against an outer wall 5*a* of the hood 5 (see FIG. 2). Meanwhile, the inclined face 22*b* of the provisional locking protrusion 22 abuts against the outer wall 5*a* of the hood 5 at the halfway point of the sliding member C. The abutment enforces the resilient support piece 20 to deflect it so that the provisional locking protrusion 22 rides over the outer wall 5*a* of the hood 5. Thereby, the resilient support piece 20 returns to its undeflected condition, and the vertical face 22*a* locks to the outer wall 5*a* . Thus, the sliding member C is provisionally locked at the position shown in FIGS. 1 and 2.

In the sliding member C that has been located at the provisional locked position, the entrance opening of the cam groove 15 can receive the cam pin 13 of the male connector housing B. Insertion of the male connector housing A into the hood 5 allows the cam pin 13 to reach the entry position of the cam groove 15.

In this stage, a releasing face 27 (see FIG. 7), formed in the connector housing B, for releasing the provisional locking protrusion 22 slides along an inclined face 22*c* (see FIGS. 11 and 12) formed in the protrusion 22 of the sliding member C. Thereby, the resilient support piece 20 deflects so that the vertical face 21*a* of the provisional locking stopper 21 releases from the outer wall 5*a* of the hood 5. At this provisional engagement stage, the terminals of the pair of connector housings A, B have not been fully connected yet.

A further advance of the sliding member C allows the provisional lock 19 to ride over the outer wall 1*b* . The inertia given to the sliding member C when released from the provisional lock 19 makes the member C move forward until the stopper 25 of the sliding member C abuts against the stopper 25 to stop at the fully inserted position. Hence, the sliding member C with the inertia can advances from the provisional locking position to the fully inserted position without a large resistant force. This prevents the sliding member C from stopping before the fully inserted position. The insertion completion that utilizes the inertia is a major feature of the invention.

The engagement of the connector housings is a simplified work, since it requires only to push the actuating portion 23 of the sliding member by hand. Furthermore, the push force of the sliding member C provides a larger engagement force for the connector housings by the came action.

For the complete insertion of the sliding member C, the cam groove 15 moves the cam pin 13, so that the connector housing B fully advances into the hood 5. As a result, each terminal in the connector housings A, B connects to its associated one to make a sure electrical connection. Thus configured connector according to the invention has such advantageous effects as discussed hereinafter.

First, in the sliding-member-equipped connector, by pushing the sliding member in the insertion direction, the provisional lock abuts against the one of the connector housings in a halfway point of the insertion so that the sliding member is provisionally locked at the provisional locked position. Whereon, the cam pin of the other of the connector housings is received in the cam groove. By further pushing the sliding member at the provisional locked position, the pair of connector housings fully engages with one another. This engagement operation is more simplified than, for example, a known lever-equipped connector.

Second, a known sliding-member-equipped connector has a possibility of incomplete insertion of the sliding member. Meanwhile, the connector according to the invention has the sliding member with the provisional lock. Hence, when the sliding member rides over the provisional lock, the sliding member obtains an inertia, which allows the sliding member to move up to the fully inserted position, surely preventing incomplete insertion of the sliding member.

Third, by the provisional lock of the sliding member in the connector according to the invention, the sliding member can easily advance from the provisional locking position to the fully inserted position. This is advantageous over a known lever-equipped connector that requires to pivot stably the lever up to the full engagement of the connector housings.

What is claimed is:

1. An electrical connector having a pair of connector housings, comprising:

a pair of first and second connector housings mateable with one another, in which terminals are accommodated therein for electrical connection, a sliding member, said sliding member being slidably positioned in a sliding member insertion slit respectively provided in each of the connector housings, said sliding member insertion slit extending in a direction crossing with the mating direction of the connector housings, a cam pin protruding from an inner surface of said sliding member insertion slit of the second connector housing, a cam groove formed in said sliding member, which engages with said cam pin so as to guide the pair of connector housings up to the fully mated state, and a provisional lock for provisionally locking said sliding member to the first connector housing, which protrudes from a sliding face of said sliding member and is resiliently supported on said sliding member, wherein an increased insertion force allows said sliding member to be released from said provisional lock so as to fully insert said sliding member into the connector housings.

2. The electrical connector having a pair of connector housings as claimed in claim 1, wherein said provisional lock is formed so as to protrude from a resilient support piece provided in said sliding member and abuts against an outer surface of the first connector housing in the provisional lock condition of said sliding member.

3. The electrical connector having a pair of connector housings as claimed in claim 1, wherein said sliding member has a stopper that abuts against the first connector housing when said sliding member has been fully inserted into the first connector housing.

4. The electrical connector having a pair of connector housings as claimed in claim 1, wherein said sliding member has a resiliently deflectable, disconnection preventing portion that locks to an inner face of the first connector housing when said sliding member has been fully inserted in the connector housings.

5. The electrical connector having a pair of connector housings as claimed in claim 1, wherein said sliding member has a flexible arm for provisionally locking said sliding member to the first connector housing together with said provisional lock.

6. The electrical connector having a pair of connector housings as claimed in claim 5, wherein the second connector housing can deflect said flexible arm to release the engagement between said flexible arm and the first connector housing when said sliding member enters the second connector housing.

7. The electrical connector having a pair of connector housings as claimed in claim 1, wherein said provisional lock is formed so as to protrude from a resilient support piece provided in said sliding member, and said resilient support piece is adjacent to an elongated opening provided in said sliding member for resiliently supporting said provisional lock.

* * * * *